US007880698B2

(12) United States Patent
Park et al.

(10) Patent No.: US 7,880,698 B2
(45) **Date of Patent: *Feb. 1, 2011**

(54) DELTA PIXEL CIRCUIT AND LIGHT EMITTING DISPLAY

(75) Inventors: Sung Cheon Park, Suwon (KR); Won Kyu Kwak, Seongnam (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 849 days.

This patent is subject to a terminal disclaimer.

(21) Appl. No.: 11/274,057

(22) Filed: Nov. 14, 2005

(65) Prior Publication Data

US 2006/0132668 A1 Jun. 22, 2006

(30) Foreign Application Priority Data

Nov. 22, 2004 (KR) ..... 10-2004-0095981

(51) Int. Cl.
*G09G 3/32* (2006.01)

(52) U.S. Cl. ..... 345/82; 345/83

(58) Field of Classification Search ..... 345/82, 345/83, 205, 206; 315/136, 169.3, 291; 257/59
See application file for complete search history.

(56) References Cited

U.S. PATENT DOCUMENTS 5,822,026 A 10/1998 Matsuo
5,952,789 A * 9/1999 Stewart et al. ..... 315/169.4
6,404,410 B1 6/2002 Shirae
6,421,033 B1 7/2002 Williams
6,583,775 B1 6/2003 Sekiya et al.
6,618,031 B1 9/2003 Bohn, Jr. et al.
6,768,482 B2 7/2004 Asano et al.
6,771,028 B1 8/2004 Winters
6,933,756 B2 * 8/2005 Miyazawa ..... 327/112
7,336,251 B2 * 2/2008 Osada ..... 345/92

(Continued)

FOREIGN PATENT DOCUMENTS

CN 1143232 A 2/1997

(Continued)

OTHER PUBLICATIONS

Patent Abstracts of Japan, Publication No. 09-138659, dated May 27, 1997, in the name of Chan-Long Shieh et al.

(Continued)

*Primary Examiner*—Quan-Zhen Wang
*Assistant Examiner*—Shaheda A Abdin
(74) *Attorney, Agent, or Firm*—Christie, Parker & Hale, LLP

(57) ABSTRACT

A delta pixel circuit and a light emitting display are able to minimize a color separation phenomenon by adjusting an emitting point of a plurality of emitting diodes (or devices), reduce the number of driving circuits, and have a high aperture ratio. A first, second, and third light emitting diodes are arranged in a delta pattern and respectively correspond to a red color, a green color, and a blue color. A driving circuit is commonly connected with the first, second, and third light emitting diodes and is for supplying a current to each of the diodes. A switching circuit is connected between the driving circuit and the first, second, and third light emitting diodes and selectively supplies the current to the first, second, and third light emitting diodes.

21 Claims, 8 Drawing Sheets

U.S. PATENT DOCUMENTS

| | | | | |
|---|---|---|---|---|
| 7,535,447 | B2 * | 5/2009 | Kwak et al. | 345/87 |
| 2002/0000576 | A1 | 1/2002 | Inukai | |
| 2002/0021293 | A1 | 2/2002 | Tam | |
| 2002/0118150 | A1 | 8/2002 | Kwon | |
| 2003/0062524 | A1 | 4/2003 | Kimura | |
| 2003/0094612 | A1 | 5/2003 | Yamazaki et al. | |
| 2003/0117348 | A1 | 6/2003 | Knapp et al. | |
| 2003/0132896 | A1 | 7/2003 | Matsueda | |
| 2004/0100427 | A1 | 5/2004 | Miyazawa | |
| 2004/0113922 | A1 | 6/2004 | Choe et al. | |
| 2004/0183758 | A1 | 9/2004 | Chen et al. | |
| 2004/0217694 | A1 | 11/2004 | Cok et al. | |
| 2004/0263499 | A1 | 12/2004 | Tanada et al. | |
| 2005/0024305 | A1 * | 2/2005 | Park | 345/82 |
| 2005/0052365 | A1 | 3/2005 | Jang | |
| 2005/0068271 | A1 | 3/2005 | Lo | |
| 2005/0083271 | A1 | 4/2005 | Suh et al. | |
| 2005/0093791 | A1 | 5/2005 | Lo | |
| 2005/0190126 | A1 | 9/2005 | Kimura et al. | |
| 2006/0038752 | A1 * | 2/2006 | Winters | 345/76 |
| 2006/0076550 | A1 | 4/2006 | Kwak et al. | |

FOREIGN PATENT DOCUMENTS

| | | | |
|---|---|---|---|
| CN | 1361510 | | 7/2002 |
| CN | 1376014 | A | 10/2002 |
| CN | 1410962 | A | 4/2003 |
| CN | 1444197 | | 9/2003 |
| CN | 1455914 | A | 11/2003 |
| CN | 1460240 | A | 12/2003 |
| CN | 1479272 | | 3/2004 |
| CN | 1497522 | A | 5/2004 |
| CN | 1530910 | A | 9/2004 |
| EP | 1 215 651 | | 6/2002 |
| JP | 9-138659 | | 5/1997 |
| JP | 2001-318628 | | 11/2001 |
| JP | 2002-023697 | | 1/2002 |
| JP | 2002-175029 | | 6/2002 |
| JP | 2002-198174 | | 7/2002 |
| JP | 2002-215093 | | 7/2002 |
| JP | 2002-215096 | | 7/2002 |
| JP | 2002-515096 | | 7/2002 |
| JP | 2002-221917 | | 8/2002 |
| JP | 2003-043999 | | 2/2003 |
| JP | 2003-108032 | | 4/2003 |
| JP | 2003-122306 | | 4/2003 |
| JP | 2003-216100 | | 7/2003 |
| JP | 2004-133240 | | 4/2004 |
| JP | 2004-279548 | | 10/2004 |
| JP | 2005-031630 | | 2/2005 |
| KR | 2000-0039659 | | 7/2000 |
| KR | 2001-0050783 | | 6/2001 |
| KR | 2002-0025842 | | 4/2002 |
| KR | 2002-0040613 | | 5/2002 |
| KR | 2003-0027858 | | 4/2003 |
| KR | 2003-0086166 | | 11/2003 |
| KR | 10-2004-0029242 | | 4/2004 |
| WO | WO 03/044762 | A1 | 5/2003 |
| WO | WO 03/071511 | | 8/2003 |

OTHER PUBLICATIONS

Patent Abstracts of Japan, Publication No. 2002-175029, dated Jun. 21, 2002, in the name of Anzai Katsuya et al.

Patent Abstracts of Japan, Publication No. 2002-198174, dated Jul. 12, 2002, in the name of Yuichi Ikezu et al.

Patent Abstracts of Japan, Publication No. 2002-221917, dated Aug. 9, 2002, in the name of Shin Asano et al.

Patent Abstracts of Japan, Publication No. 2003-108032, dated Apr. 11, 2003, in the name of Katsuya Anzai.

Patent Abstracts of Japan, Publication No. 2003-122306, dated Apr. 25, 2003, in the name of Akira Yumoto.

Patent Abstracts of Japan, Publication No. 2004-133240, dated Apr. 30, 2004, in the name of Shin Asano et al.

Korean Patent Abstracts, Publication No. 1020030027858 A, dated Apr. 7, 2003, in the name of Katsuya Anzai.

Patent Abstracts of Japan, Publication No. 2002-023697, dated Jan. 23, 2002, in the name of Kazutaka Inukai.

Patent Abstracts of Japan, Publication No. 2002-215093 dated Jul. 31, 2002, in the name of Akira Yumoto et al.

Patent Abstracts of Japan, Publication No. 2002-215096, dated Jul. 31, 2002, in the name of Oh-Kyong Kwon.

Patent Abstracts of Japan, Publication No. 2003-043999, dated Feb. 14, 2003, in the name of Suzuki.

Patent Abstracts of Japan, Publication No. 2003-216100, dated July 30, 2003, in the name of Hiroshi Takahara.

Korean Patent Abstracts, Publication No. 1020000039659 A; Date of Publication: Jul. 5, 2000; in the name of U Yeong Kim et al.

Korean Patent Abstracts, Publication No. 1020010050783 A; Date of Publication: Jun. 25, 2001; in the name of Tsutomu Yamada.

Korean Patent Abstracts, Publication No. 1020020025842 A, dated Apr. 4, 2002, in the name of Katsuya Anzai et al.

Korean Patent Abstracts, Publication No. 1020020040613 A, dated May 30, 2002, in the name of Mitsuru Asano.

Korean Patent Abstracts, Publication No. 1020030086166 A; Date of Publication: Nov. 7, 2003; in the name of Gi Seong Chae et al.

Korean Patent Abstracts, Publication No. 1020040029242 A; Date of Publication: Apr. 6, 2004; in the name of Jong Cheol Chae et al.

U.S. Office action dated Oct. 3, 2008, for related U.S. Appl. No. 11/239,726, indicating relevance of U.S. Patent 6,618,031, and U.S. Publication 2003/0117348, filed in an IDS dated Oct. 31, 2008.

U.S. Office action dated Sep. 28, 2009, for related U.S. Appl. No. 11/129,016, noting listed U.S. Publication references in this IDS.

S.M. Choi et al., A *Self-compensated Voltage Programming Pixel Structure for Active-Matrix Organic Light Emitting Diodes*, IDW 2003, Proceedings of the 10th Int'l Display Workshops, pp. 535-538, XP 008057381.

Japanese Office action dated Apr. 7, 2009, for Japanese application 2005-306198, noting Japanese references listed in this IDS.

U.S. Office action dated Aug. 3, 2009, for related U.S. Appl. No. 11/239,726, noting U.S. Patent 7,535,447 cited in Jul. 7, 2009 Office action.

Chinese Patent Publication dated Oct. 7, 2009, for Chinese application 200510129187.6, noting the foreign references listed in this IDS, as well as CN 1376014 and CN 1530910, both previously filed in an IDS dated Oct. 31, 2008.

Office action for related U.S. Appl. No. 11/239,726 dated Jan. 15, 2010, noting U.S. 6,404,410 listed in this IDS.

U.S. Office action dated Mar. 4, 2010, for related U.S. Appl. No. 11/129,016, noting listed reference in this IDS.

U.S. Office action dated Feb. 18, 2010, for related U.S. Appl. No. 12/247,171, noting listed reference in this IDS.

U.S. Office action dated Jul. 19, 2010, for related U.S. Appl. No. 11/129,016, noting the reference listed in this IDS.

* cited by examiner

DELTA PIXEL CIRCUIT AND LIGHT EMITTING DISPLAY

CROSS-REFERENCE TO RELATED APPLICATION

This application claims priority to and the benefit of Korean Patent Application No. 10-2004-95981, filed on Nov. 22, 2004, in the Korean Intellectual Property Office, the entire disclosure of which is incorporated herein by reference.

BACKGROUND

1. Field of the Invention

The present invention relates to a delta pixel circuit and a light emitting display, and more particularly, to a delta pixel circuit and a light emitting display having three delta-arranged light emitting diodes connected with one pixel circuit to be emitted to thereby provide a simple wiring structure and a high aperture ratio.

2. Discussion of Related Art

Recently, various panel display devices having weight and volume less than a comparable cathode ray tube have been developed. A light emitting display panel device (or light emitting display) using a light emitting diode (LED) is of special interest because of its fast response time and outstanding emitting efficiency, brightness, and angular field.

An LED emits light when an exciton is generated by a recombination of an electron and a hole and then falls to a low energy level. The LED can be composed of organic electroluminescent layers or inorganic electroluminescent layers and, thus, can be categorized as either an organic light emitting diode (OLED) including organic electroluminescent layers or an inorganic light emitting diode including inorganic electroluminescent layers according to the material and structure of the LED.

Also, an arrangement pattern for LEDs in a light emitting display can be classified as either a delta arrangement pattern or a stripe arrangement pattern.

FIG. 1 shows an exemplary block diagram having a pixel arrangement of a delta pattern in an organic light emitting display according to the prior art.

As shown in FIG. 1, the delta arrangement is repeatedly arranged so that unit pixels 11 having red, green, and blue colors in even rows may deviate in position from corresponding unit pixels 11 in odd rows at regular intervals. In the delta arrangement, a data line (e.g., a data line Dm−1) supplies a data signal representing one color (e.g., green).

FIG. 2 shows a schematic circuit diagram of unit pixels in an organic light emitting display according to the prior art.

As shown in FIG. 2, in a unit pixel, a source of a first transistor T1 is connected with a power supply Vdd, a drain of the first transistor T1 is connected with a source of a third transistor T3 and a gate of the first transistor T1 is connected with a first node A. The first node A is connected with a drain of a second transistor T2. The first transistor T1 supplies a current corresponding to a data signal to an organic light emitting diode OLED.

A source of the second transistor T2 is connected with a data line D1, a drain of the second transistor T2 is connected with the first node A and a gate of the second transistor T2 is connected with a first scanning line S1. As such, the second transistor T2 supplies the data signal to the first transistor T1 according to a scanning signal supplied to the gate of the second transistor T2.

The source of the third transistor T3 is connected with the drain of the first transistor T1, a drain of the third transistor T3 is connected with an anode electrode of the organic light emitting diode OLED, and a gate of the third transistor T3 responds to a light emitting control signal by being connected with a light emitting control line E1. Accordingly, a light emission of the organic light emitting diode OLED is controlled by controlling a current which flows from the first transistor T1 to the organic light emitting diode OLED according to the light emitting control signal.

A capacitor Cst is connected with the first power supply Vdd via a first electrode of the capacitor Cst, and a second electrode of the Cst is connected with the first node A. Because of this, the capacitor Cst can maintain a charge according to the data signal and supplies a signal to the gate of the first transistor T1 according to the maintained charge during one frame to thereby maintain an operation of the first transistor T1 during one frame.

However, because one pixel circuit is connected with only one light emitting diode OLED, a large number of pixel circuits are needed to emit a plurality of light emitting diodes OLEDs.

Also, because one light emitting control line needs to be connected with a pixel row, an aperture ratio of the conventional light emitting display is reduced due to the light emitting control line.

SUMMARY OF THE INVENTION

Accordingly, an embodiment of the present invention provides a delta pixel circuit and a light emitting display that are able to minimize a color separation phenomenon by adjusting emitting points of a plurality of emitting devices (or diodes), able to reduce a number of components, and/or able to have a high aperture ratio.

A first embodiment of the present invention provides a pixel including: first, second, and third light emitting diodes arranged in a delta pattern and respectively corresponding to a red color, a green color, and a blue color; a driving circuit commonly connected with the first, second, and third light emitting diodes and for supplying a current to each of the first, second, and third light emitting diodes; and a switching circuit connected between the driving circuit and the first, second, and third light emitting diodes and for selectively supplying the current to the first, second, and third light emitting diodes, wherein the driving circuit includes: a first transistor for receiving a first power of a first power source, and for selectively supplying the current to the first, second, and third light emitting diodes, the current corresponding to a first voltage supplied to a gate of the first transistor; a second transistor for selectively supplying a data signal to a first electrode of the first transistor according to a first scanning signal; a third transistor for selectively connecting the first transistor as a diode according to the first scanning signal; a capacitor for storing a voltage supplied to the gate of the first transistor when a data voltage of the data signal is supplied to the first electrode of the first transistor and for maintaining the stored voltage at the gate of the first transistor during an emitting interval of at least one of the first, second, and third light emitting diodes; a fourth transistor for selectively supplying an initializing signal to the capacitor according to a second scanning signal; a fifth transistor for selectively supplying the first power of the first power source to the first transistor according to a first light emitting control signal; a sixth transistor for selectively supplying the first power of the first power source to the first transistor according to a second light emitting control signal; and a seventh transistor for selectively supplying the first power of the first power source to the first transistor according to a third light emitting control signal.

A second embodiment of the present invention provides a light emitting display including: a plurality of pixels for displaying a picture; a scan driver for supplying first and second scanning signals and a light emitting control signal to at least one of the plurality of pixels; a data driver for supplying a data signal to the at least one of the plurality of pixels, wherein the at least one of the pixels is according to the first embodiment.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
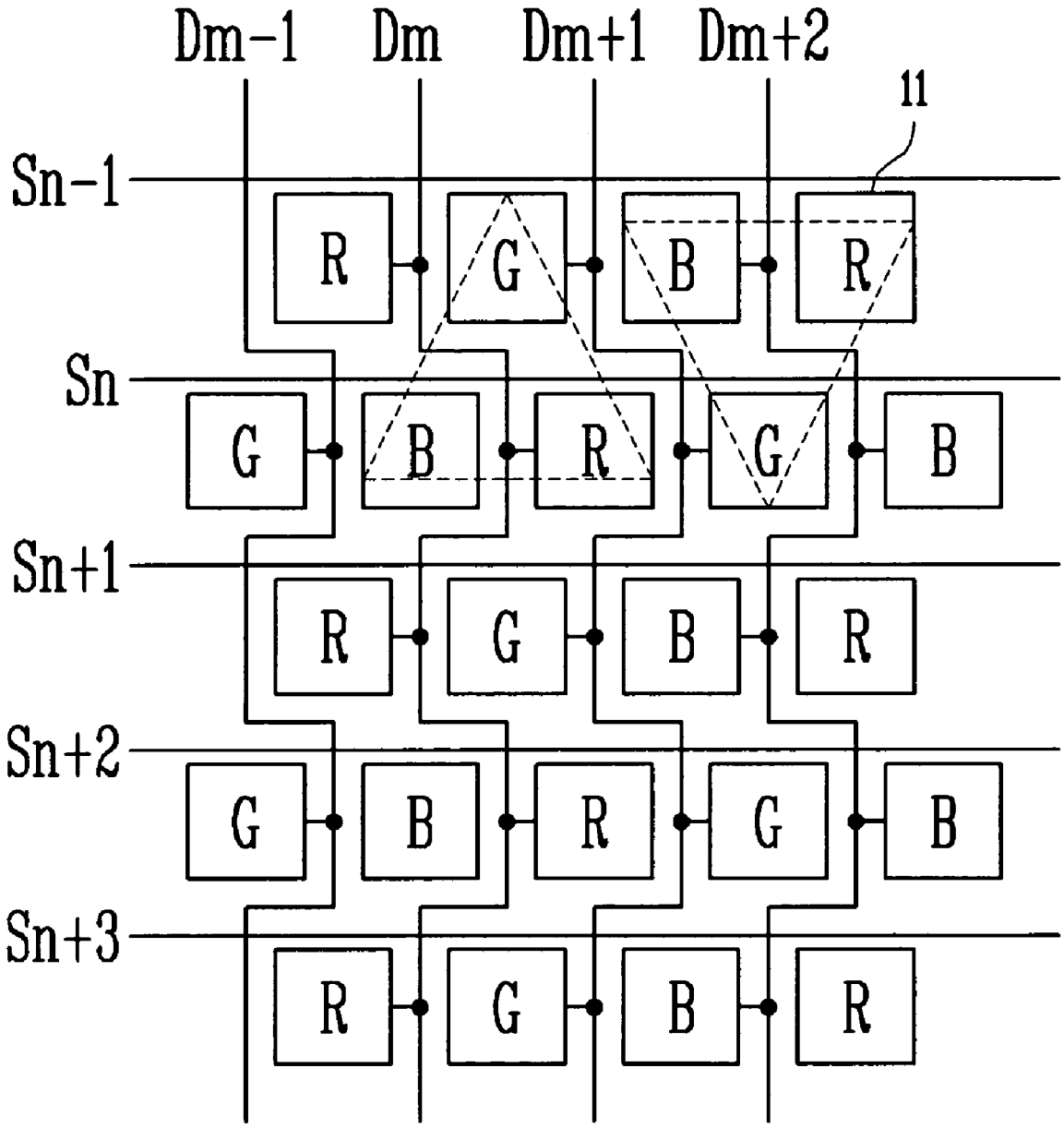
FIG. 1 (PRIOR ART)
FIG. 1 shows an exemplary block diagram having a pixel arrangement of a delta pattern in a light emitting display according to the prior art.
Figure 2:
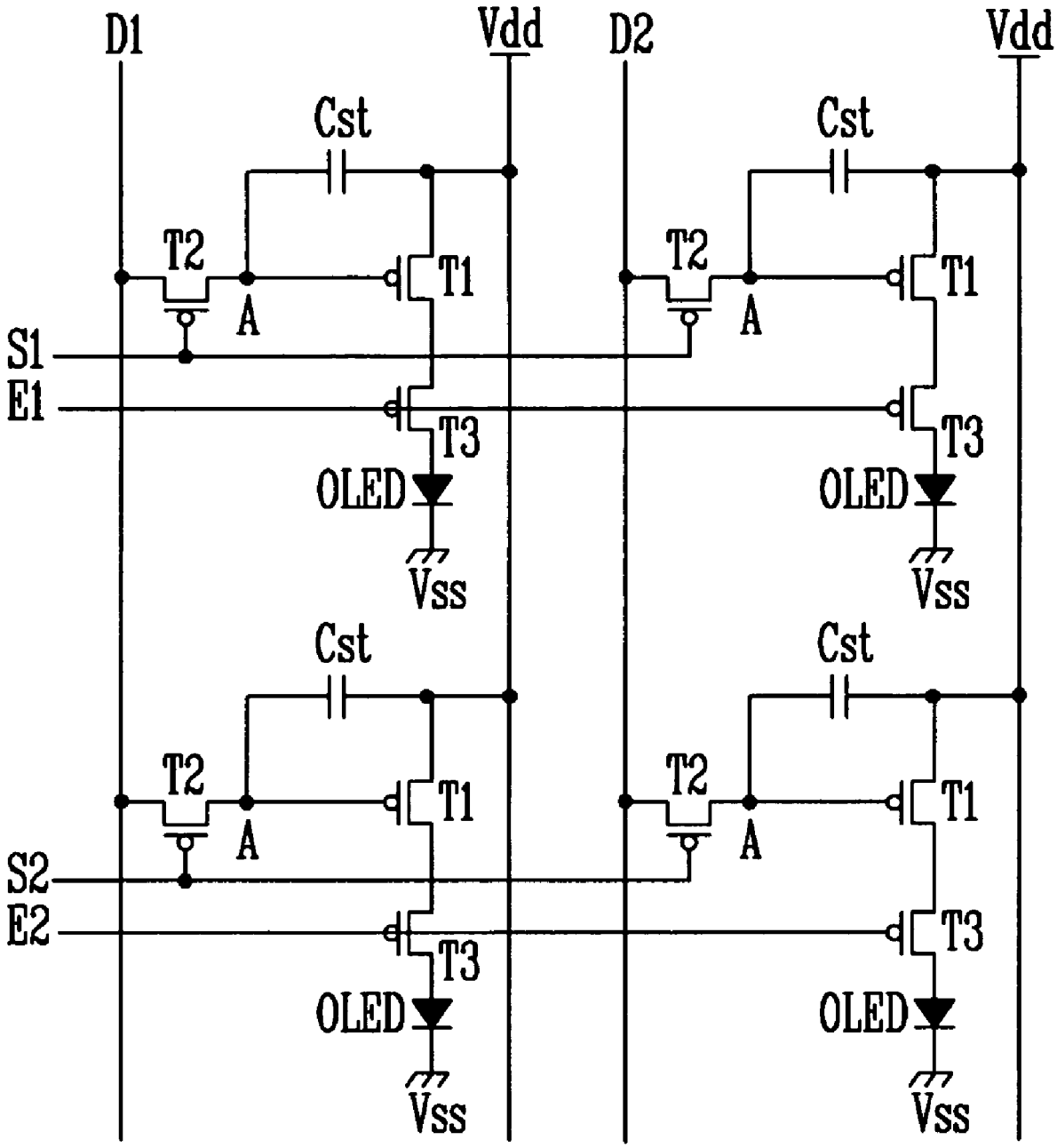
FIG. 2 (PRIOR ART)
FIG. 2 shows a schematic circuit diagram of unit pixels in a light emitting display according to the prior art.

In the following detailed description, certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive. There may be parts shown in the drawings, or parts not shown in the drawings, that are not discussed in the specification, as they are not essential to a complete understanding of the invention. In addition, when one part is connected to another part, the one part may be directly connected to the another part or may be indirectly connected to the another part via yet another part. Like reference numerals designate like elements.

Figure 3:
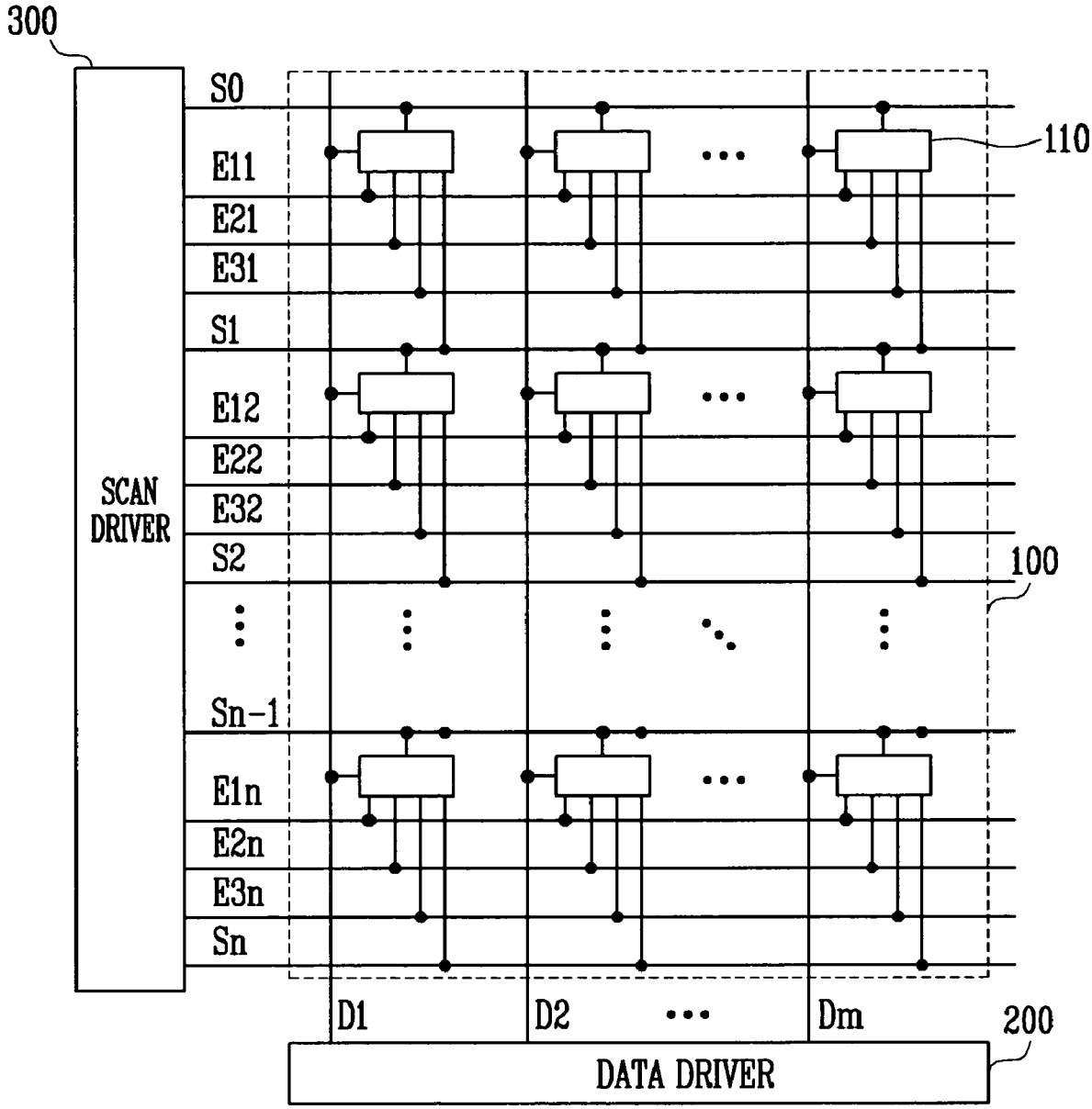
FIG. 3 shows a block diagram of a light emitting display according to an exemplary embodiment of the present invention.

FIG. 3 shows a block diagram of a light emitting display according to the present invention.

As shown in FIG. 3, the light emitting display includes a displaying unit 100, a data driver 200, and a scan driver 300.

The displaying unit 100 includes a plurality of pixels 110, each having three light emitting diodes and a pixel circuit, a plurality of scanning lines S0, S1, S2, . . . , Sn−1, Sn arranged in a row direction, a plurality of first light emitting control lines E11, E12, . . . , E1n−1, E1n arranged in a row direction, a plurality of second light emitting control lines E21, E22, . . . , E2n−1, E2n arranged in the row direction, a plurality of third light emitting control lines E31, E32, . . . , E3n−1, E3n arranged in the row direction, a plurality of data lines D1, D2, . . . , Dm−1, Dm arranged in a column direction, and a plurality of pixel power lines (not shown) for supplying pixel power. Herein, the plurality of pixel power lines are supplied from an external source that supply the pixel power.

Also, each of the plurality of pixels 110 receives a scanning signal of a current scanning line and a scanning signal of a former scanning line through the plurality of scanning lines S0, S1, S2, . . . , Sn−1, Sn, and generates a driving current corresponding to a data signal supplied to the plurality of data lines D1, D2, . . . , Dm−1, Dm. The driving current is supplied to a light emitting diode OLED through the plurality of first light emitting control lines E11, E12, . . . , E1n−1, E1n to the plurality of third light emitting control lines E31, E32, . . . , E3n−1, E3n, and thus a picture is displayed.

Each of the pixels 110 includes three unit pixels. One unit pixel is embodied as one light emitting diode, the three unit pixels respectively representing a red color, a green color, and a blue color. The unit pixels are arranged in a delta pattern.

The data driver 200 is connected with the plurality of data lines D1, D2, . . . , Dm−1, Dm to thereby supply a data signal to the displaying unit 100. A data line sequentially supplies data according to a green color, a red color, and a blue color.

The scan driver 300 is composed at a side of the displaying unit 100, connecting with the plurality of scanning lines S0, S1, S2, . . . , Sn−1, Sn and the plurality of first light emitting control lines E11, E12, . . . , E1n−1, E1n to the plurality of third light emitting control lines E31, E32, . . . , E3n−1, E3n to thereby sequentially supply a scanning signal and first, second, and third light emitting control signals to the displaying unit 100.

Figure 4:
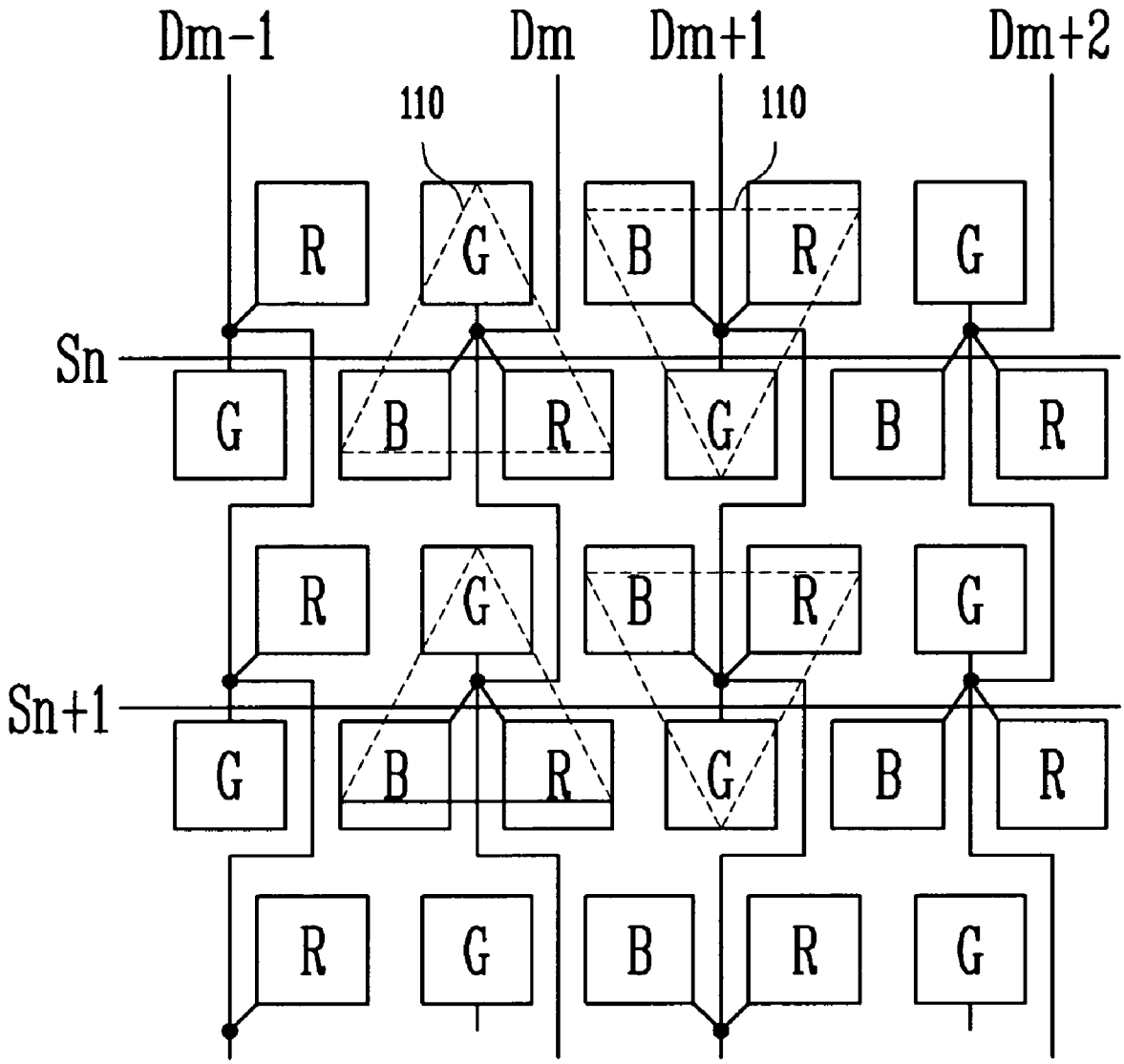
FIG. 4 shows a schematic circuit diagram of unit pixels in the light emitting display of FIG. 3.

FIG. 4 shows a schematic circuit diagram of unit pixels in the light emitting display of FIG. 3.

As shown in FIG. 4, three unit pixels are arranged as a delta arrangement pattern, receive a scanning signal by being connected with one pixel circuit, and then are emitted.

In the present invention, two scanning lines can emit a fourth row unit pixel, as compared to an arrangement of a delta pixel according to the prior art in FIG. 1, wherein four scanning lines are required to emit a fourth row unit pixel. Accordingly, the present invention uses a smaller number of scanning lines than the prior art, a wiring structure of the light emitting display is simplified because of the reduction of the scanning lines, and an aperture ratio of the light emitting display increases.

Figure 5:
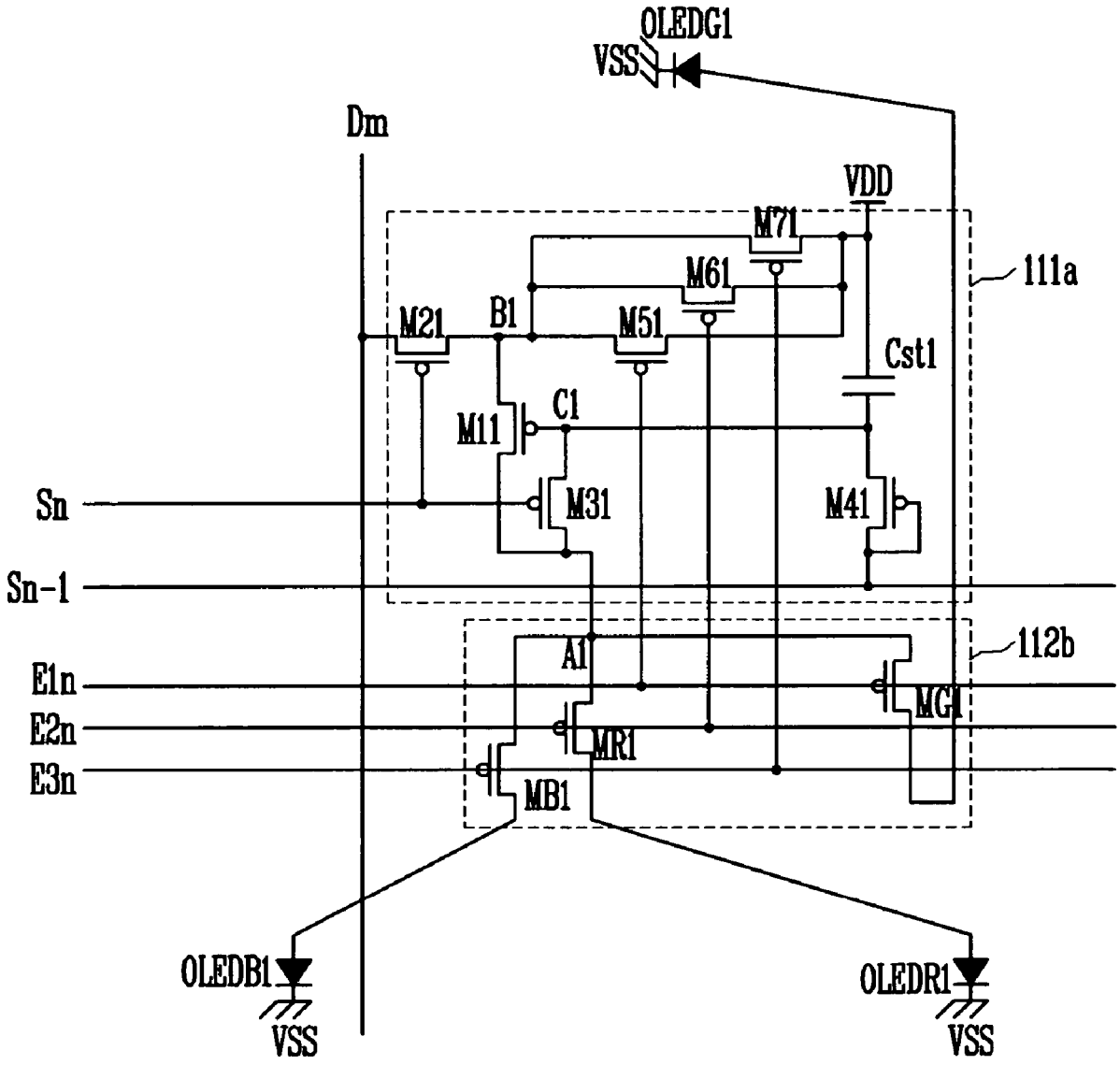
FIG. 5 shows a schematic circuit diagram of a unit pixel adopted in the light emitting display of FIG. 3 according to a first exemplary embodiment.

FIG. 5 shows a schematic circuit diagram of a unit pixel adopted in the light emitting display of FIG. 3 according to a first exemplary embodiment.

As shown in FIG. 5, a pixel circuit includes first to seventh transistors M11 to M71, first to third switching devices MG1, MR1, MB1, and a capacitor Cst1, wherein the first to seventh transistors M11 to M71 and the first to third switching devices MG1, MR1, MB1 are each composed of a P-type transistor (e.g., a PMOS transistor). Each of the transistors M11 to M71 includes a source, a drain and a gate, and the capacitor Cst1 includes a first electrode and a second electrode. Drains and sources of the first to seventh transistors M11 to M71 and the first to third switching devices MG1, MR1, MB1 are substantially the same, and a source and a drain can also respectively be referred to as a first electrode and a second electrode.

A drain of the first transistor M11 is connected with a first node A1, a source of the first transistor M11 is connected with a second node B1, and a gate of the first transistor M11 is connected with a third node C1. Thus, the first transistor M11 flows a current from the second node B1 into the first node A1 according to a voltage of the third node C1.

A source of the second transistor M21 is connected with a data line Dm, a drain of the second transistor M21 is connected with the second node B1, a gate of the second transistor M21 is connected with a first scanning line Sn, and the second transistor M21 performs a switching operation according to a scanning signal sn supplied by the first scanning line Sn to thereby selectively supply to the second node B1 a data signal supplied by the data line Dm.

A source of the third transistor M31 is connected with the third node C1, a drain of the third transistor M31 is connected with the first node A1, a gate of the third transistor M31 is connected with the first scanning line Sn, and the third transistor M31 equalizes a voltage level of the first node A1 with a voltage level of the third node C1 according to the scanning signal sn supplied by the first scanning line Sn so that the first transistor M11 can be connected like a diode.

A source and a gate of the fourth transistor M41 are connected with a second scanning line Sn−1, and a drain of the fourth transistor M41 is connected with the third node C1 to thereby supply an initializing signal to the third node C1. The initializing signal is supplied by the second scanning line Sn−1, and the second scanning line Sn−1 is a scanning line connected with a row that precedes by one row a row connected with the first scanning line Sn.

A source of the fifth transistor M51 is connected with a pixel power source Vdd, a drain of the fifth transistor M51 is connected with a second node B1, and a gate of the fifth transistor M51 is connected with a first light emitting control line E1n. Thus, the fifth transistor M51 selectively supplies a pixel power to the second node B1 according to a first light emitting control signal E1n supplied by the first light emitting control line E1n.

A source of the sixth transistor M61 is connected with a pixel power source Vdd, a drain of the sixth transistor M61 is connected with a second node B1, and a gate of the sixth transistor M61 is connected with a second light emitting control line E2n. Thus, the sixth transistor M61 selectively supplies a pixel power to the second node B1 according to a second light emitting control signal e2n supplied by the second light emitting control line E2n.

A source of the seventh transistor M71 is connected with a pixel power source Vdd, a drain of the seventh transistor M71 is connected with a second node B1, and a gate of the seventh transistor M71 is connected with a third light emitting control line E3n. Thus, the seventh transistor M71 selectively supplies a pixel power to the second node B1 according to a third light emitting control signal e3n supplied by the third light emitting control line E3n.

A source of the first switching device MG1 is connected with the first node A1, a drain of the first switching device MG1 is connected with a first organic light emitting diode OLEDG1, a gate of the first switching device MG1 is connected with the first light emitting control line E1n, and the first switching device MG1 flows a current (that has flown into the first node A1) according to first light emitting control signal e1n supplied by the first light emitting control line E1n into the first organic light emitting diode OLEDG1 to thereby emit the first organic light emitting diode OLEDG1.

A source of the second switching device MR1 is connected with the first node A1, a drain of the second switching device MR1 is connected with a second organic light emitting diode OLEDR1, a gate of the first switching device MR1 is connected with the second light emitting control line E2n and the second switching device MR1 flows a current (that has flown into the first node A1) according to the second light emitting control signal e2n supplied by the second light emitting control line E2n into the second organic light emitting diode OLEDR1 to thereby emit the second organic light emitting diode OLEDR1.

A source of the third switching device MB1 is connected with the first node A1, a drain of the third switching device MB1 is connected with a third organic light emitting diode OLEDB1, a gate of the third switching device MB1 is connected with the third light emitting control line E3n and the third switching device MB1 flows a current (that has flown into the first node A1) according to the third light emitting control signal e3n supplied by the third light emitting control line E3n into the third organic light emitting diode OLEDB1 to thereby emit the third organic light emitting diode OLEDB1.

A first electrode of the capacitor Cst1 is connected with the pixel power source Vdd, and a second electrode of the capacitor Cst1 is connected with the third node C1. Thus, the capacitor Cst1 is initialized by the initializing signal supplied to the third node C1 through the fourth transistor M41, stores a voltage corresponding to the data signal, and maintains a gate voltage of the first transistor M11 for a predetermined time interval.

Figure 6:
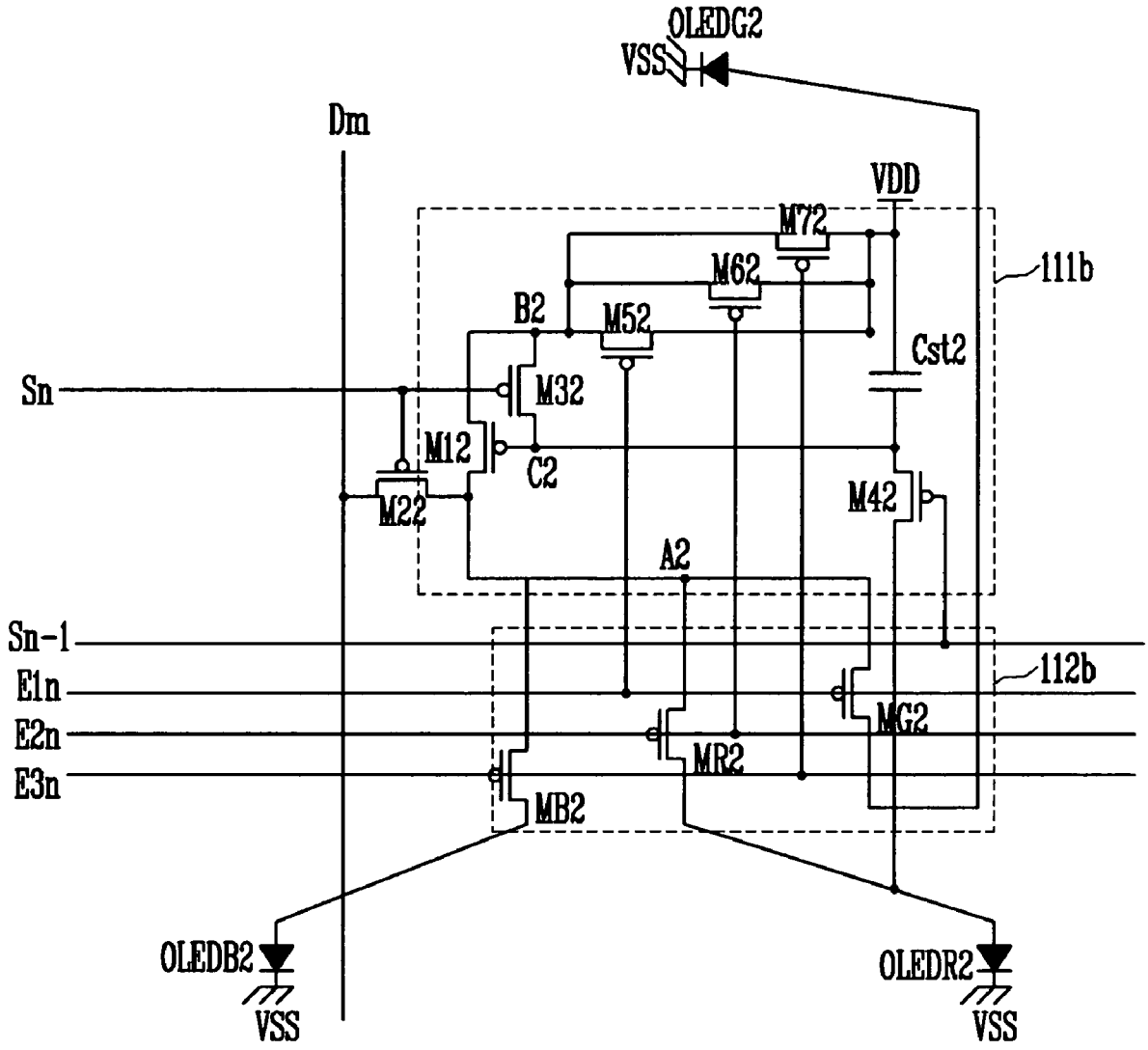
FIG. 6 shows a schematic circuit diagram of a unit pixel adopted in the light emitting display of FIG. 3 according to a second exemplary embodiment.

FIG. 6 shows a schematic circuit diagram of a unit pixel adopted in the light emitting display of FIG. 3 according to a second exemplary embodiment.

As shown in FIG. 6, a pixel circuit includes first to seventh transistors M12 to M72, first to third switching devices MG2, MR2, MB2 and a capacitor Cst2, wherein the first to seventh transistors M12 to M72 and the first to third switching devices MG2, MR2, MB2 are each composed of a P-type transistor. Each of the transistors M12 to M72 includes a source, a drain and a gate, and the capacitor Cst2 includes a first electrode and a second electrode. Drains and sources of the first to seventh transistors M12 to M72 and the first to third switching devices MG2, MR2, MB2 are substantially the same, and a source and a drain can also respectively be referred to as a first electrode and a second electrode.

A drain of the first transistor M12 is connected with a first node A2, a source of the first transistor M12 is connected with a second node B2 and a gate of the first transistor M12 is connected with a third node C2. Thus, the first transistor M12 flows a current from the second node B2 into the first node A2 according to a voltage of the third node C2.

A source of the second transistor M22 is connected with a data line Dm, a drain of the second transistor M22 is connected with the first node A2, a gate of the second transistor M22 is connected with a first scanning line Sn, and the second transistor M22 performs a switching operation according to a scanning signal sn supplied by the first scanning line Sn to thereby selectively supply to the first node A2 a data signal supplied by the data line Dm.

A source of the third transistor M32 is connected with the second node B2, a drain of the third transistor M32 is connected with the third node C2, a gate of the third transistor M32 is connected with the first scanning line Sn, and the third transistor M32 equalizes a voltage level of the first node A2 with a voltage level of the third node C2 according to the scanning signal sn supplied by the first scanning line Sn so that the first transistor M12 can be connected like a diode.

A source of the fourth transistor M42 is connected with an anode of at least one of the first, second, and third light emitting diodes OLEDG2, OLEDR2, and OLEDB2; a gate of the fourth transistor M42 is connected with a second scanning line Sn−1; and a drain of the fourth transistor M42 is connected with the third node C2. The fourth transistor M42 is operated according to a second scanning signal sn−1 of the second scanning line Sn−1 and thus, when a current does not flow into a light emitting diode, the fourth transistor M42 initializes the capacitor Cst2 by using a voltage supplied to the light emitting diode and supplying that voltage to the third node C2.

A source of the fifth transistor M52 is connected with a pixel power source Vdd, a drain of the fifth transistor M52 is connected with a second node B2, and a gate of the fifth transistor M52 is connected with a first light emitting control line E1n. Thus, the first transistor M5 selectively supplies a pixel power to the second node B2 according to a first light emitting control signal E1n supplied by the first light emitting control line E1n.

A source of the sixth transistor M62 is connected with a pixel power source Vdd, a drain of the sixth transistor M6 is connected with a second node B2, and a gate of the sixth transistor M62 is connected with a second light emitting control line E2n. Thus, the sixth transistor M62 selectively supplies a pixel power to the second node B2 according to a second light emitting control signal e2n supplied by the second light emitting control line E2n.

A source of the seventh transistor M72 is connected with a pixel power source Vdd, a drain of the seventh transistor M72 is connected with a second node B2, and a gate of the seventh transistor M72 is connected with a third light emitting control line E3n. Thus, the seventh transistor M72 selectively supplies a pixel power to the second node B2 according to a third light emitting control signal e3n supplied by the third light emitting control line E3n.

A source of the first switching device MG2 is connected with the first node A2, a drain of the first switching device MG2 is connected with a first organic light emitting display OLEDG2, a gate of the first switching device MG2 is connected with the first light emitting control line E1n, and the first switching device MG2 flows a current (that has flown into the first node A2) according to first light emitting control signal E1n supplied by the first light emitting control line E1n into the first organic light emitting display OLEDG2 to thereby emit the first organic light emitting diode OLEDG2.

A source of the second switching device MR2 is connected with the first node A2, a drain of the second switching device MR2 is connected with a second organic light emitting diode OLEDR2, a gate of the first switching device MR2 is connected with the second light emitting control line E2n, and the second switching device MR2 flows a current (that has flown into the first node A2) according to the second light emitting control signal e2n supplied by the second light emitting control line E2n into the second organic light emitting diode OLEDR2 to thereby emit the second organic light emitting diode OLEDR2.

A source of the third switching device MB2 is connected with the first node A2, a drain of the third switching device MB2 is connected with a third organic light emitting diode OLEDB2, a gate of the third switching device MB2 is connected with the third light emitting control line E3n, and the third switching device MB2 flows a current (that has flown into the first node A2) according to the third light emitting control signal e3n supplied by the third light emitting control line E3n into the third organic light emitting diode OLEDB2 to thereby emit the third organic light emitting diode OLEDB2.

A first electrode of the capacitor Cst2 is connected with the pixel power source Vdd and a second electrode of the capacitor Cst2 is connected with the third node C2. Thus, the capacitor Cst2 is initialized by the initializing signal supplied to the third node C2 through the fourth transistor M42, stores a voltage corresponding to the data signal, and maintains a gate voltage of the first transistor M12 for a predetermined time interval.

Figure 7:
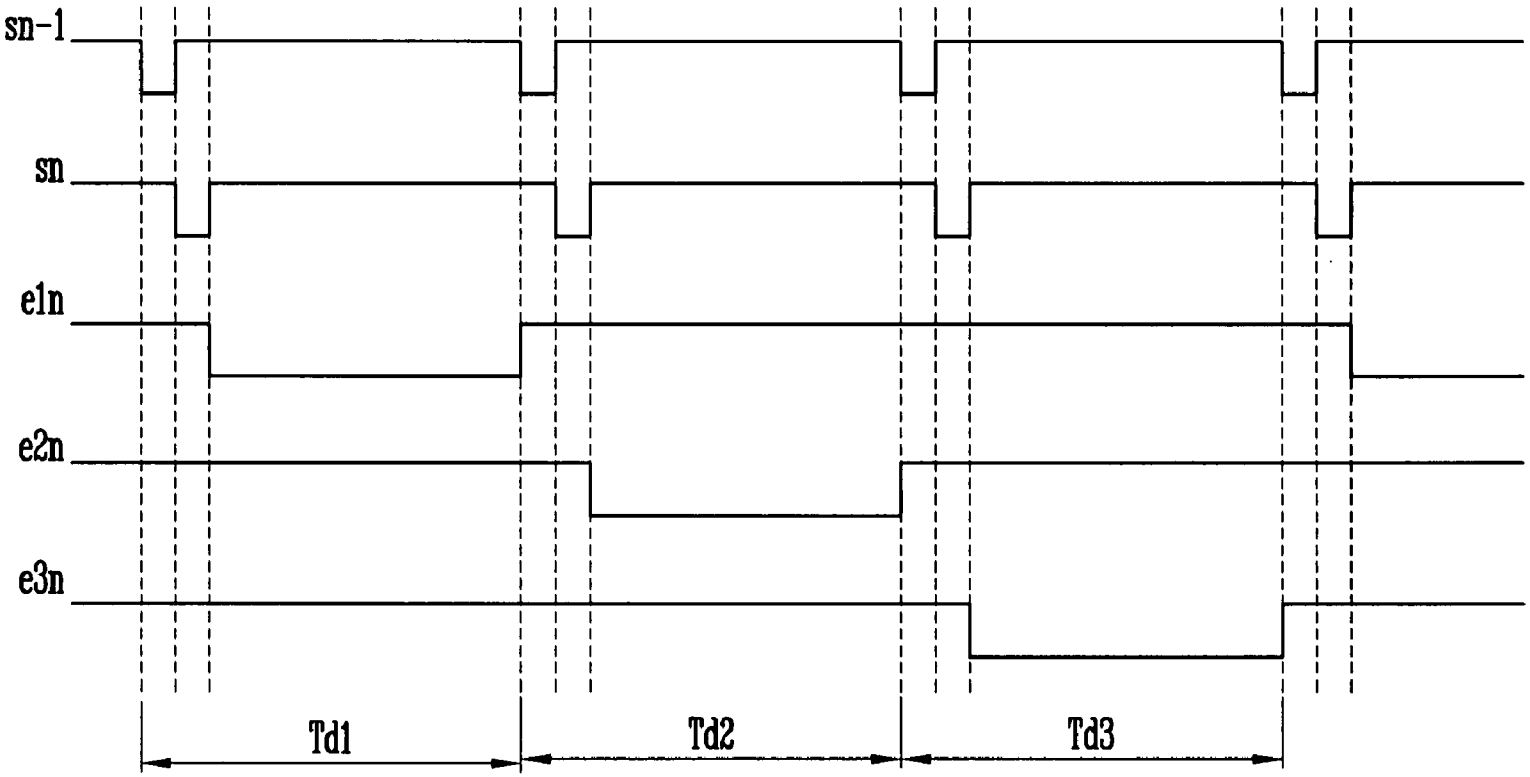
FIG. 7 shows an exemplary diagram of a waveform supplied to a light emitting display adopting the pixel depicted in FIG. 5 and/or the pixel depicted in FIG. 6.

FIG. 7 shows an exemplary diagram of a waveform supplied to a light emitting display device adopting the pixel depicted in FIG. 5 and/or the pixel depicted in FIG. 6.

As shown in FIG. 7, a pixel is operated by first and second scanning signals sn and sn−1, a data signal, and first to third light emitting control signals E1n to e3n. The first and second scanning signals sn and sn−1 and the first to third light emitting control signals E1n to e3n are periodical signals having first to third intervals Td1 to Td3.

In the first interval Td1, the first light emitting control signal E1n is in a low-state, and the second and third light emitting control signals e2n and e3n are in high-states. In the second interval Td2, the first and third light emitting control signals E1n and e3n are in high-states, and the second light emitting control signal e2n is in a low-state. In the third interval Td3, the first and second light emitting control signals e1n and e2n are in high-states, and the third light emitting control signal e3n is in a low-state.

The second scanning signal sn−1 is a scanning signal of a line prior to the line of the first scanning signal sn, and the first and second scanning signals sn and sn−1 are sequentially in a low-state for a moment at a start point of each of the intervals Td1, Td2, Td3.

In the first interval Td1, a fourth transistor M4 (e.g., M41 or M42) is turned on by the low-state of the second scanning signal sn−1. In FIG. 5, the second scanning signal sn−1 is supplied to a capacitor Cst (e.g., Cst1) through the fourth transistor M4 (e.g., M41), and thus the capacitor Cst is initialized. In FIG. 6, a capacitor Cst (e.g., Cst2) is initialized by a voltage applied to at least one of the OLEDs (e.g., OLEDR2). Next, the second transistor M2 (e.g., M21 or M22) and the third transistor M3 (e.g., M31 or M32) are turned on by the low-state of the first scanning signal sn, and thus the first transistor M1 (e.g., M11 of M12) is connected like a diode. Next, a data signal including a green color data through the second transistor M2 is supplied to the first transistor M1. Accordingly, the data signal is supplied to the second electrode of the capacitor Cst through the second transistor M2, the first transistor M1, and the third transistor M3; and thus a voltage corresponding to the difference between the data signal and a threshold voltage of the first transistor M1 is supplied to the capacitor Cst.

Also, after the first scanning signal sn is converted into a high-state, the light emitting control signal E1n is converted into a low-state. This low-state lasts for a predetermined time interval, the fifth transistor M5 is turned on according to the first light emitting control signal E1n at the low-state, and thus a voltage corresponding to the following equation 1 is supplied between a gate and a source of the first transistor M1.

$$Vsg = Vdd - (V\text{data} - |Vth|) \quad (1)$$

in which Vsg is a voltage between a source and a gate of the first transistor M1, Vdd is a pixel power, Vdata is a voltage of a data signal, and Vth is a threshold voltage of the first transistor M1.

At this time, a first switching device MG (e.g., MG1 or MG2) is turned on, thus a current corresponding to the following equation 2 flows into a first light emitting diode OLEDG (e.g., OLEDG1 or OLEDG2), and then the first light emitting diode OLEDG emits a green color light.

$$I_{OLED} = \frac{\beta}{2}(Vgs - |Vth|)^2 = \frac{\beta}{2}(Vdata - Vdd + |Vth| - |Vth|)^2 = \frac{\beta}{2}(Vdata - Vdd) \quad (2)$$

in which $I_{OLED}$ is a current which flows into a light emitting diode, Vgs is a voltage supplied to a gate of the first transistor M1, Vdd is a voltage of a pixel power, Vth is a threshold voltage of the first transistor M1, and Vdata is a voltage of a data signal.

Accordingly, the current $I_{OLED}$, which flows into a light emitting diode, flows regardless of a threshold voltage of the first transistor M1.

In the second and the third interval Td2 and Td3, a current is generated in substantially the same manner as the first interval Td1 and thus second and third light emitting diodes OLEDR, OLEDG are emitted. In the second interval Td2, a data signal including a red color data is supplied, and, in the third interval Td3, a data signal including a blue color data is supplied.

Accordingly, the first to third light emitting diodes OLEDG, OLEDR, OLEDB are sequentially emitted.

Figure 8:
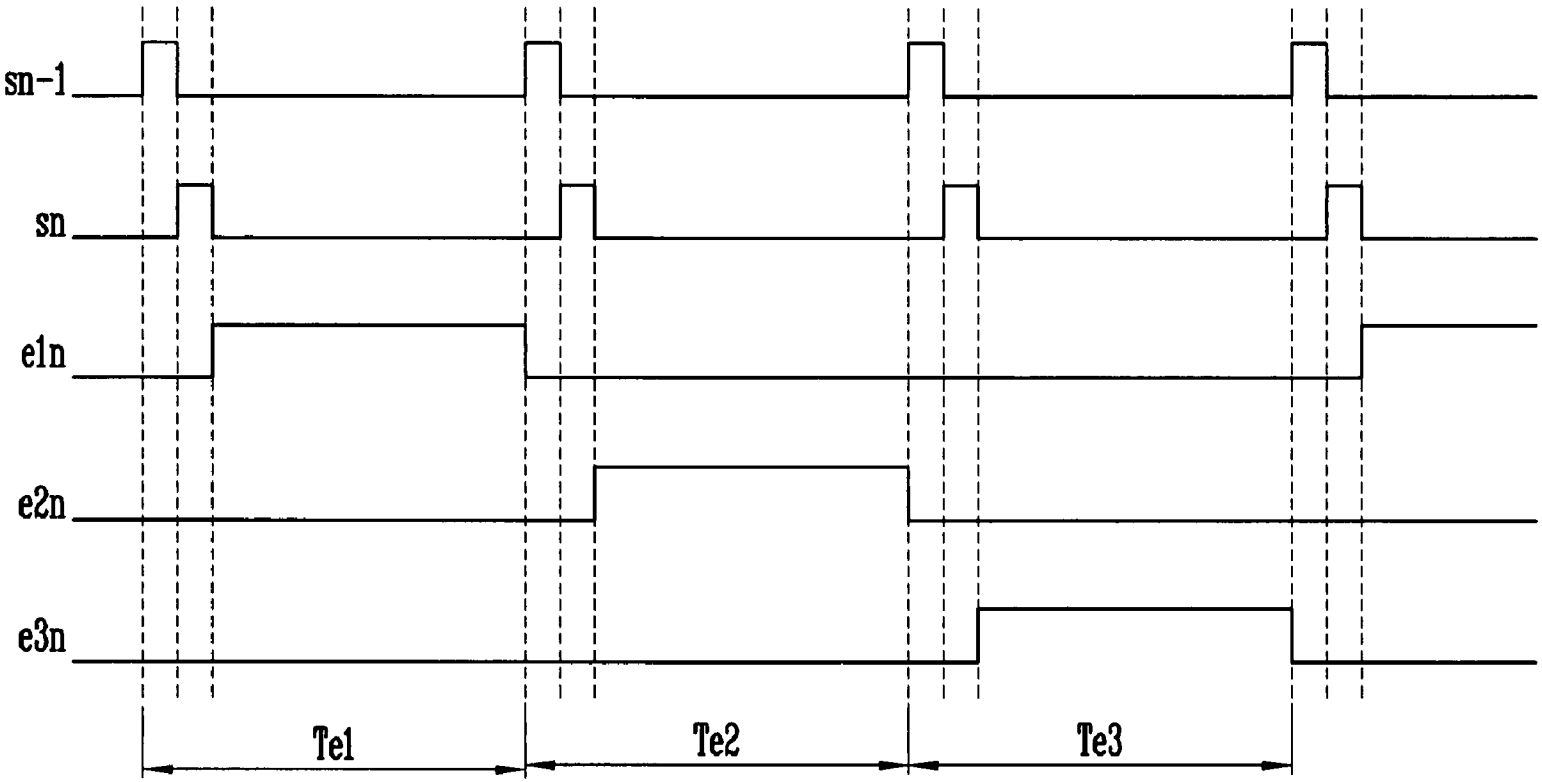
FIG. 8 shows an exemplary diagram of another waveform supplied to a light emitting display adopting the pixel depicted in FIG. 5 and/or the pixel depicted in FIG. 6.

FIG. 8 shows an exemplary diagram of another waveform supplied to a light emitting display of a case in which the pixels of FIGS. 5 and 6 are formed with N-type transistors (e.g., NMOS transistors) instead of P-type transistors (e.g., PMOS transistors). Referring to FIG. 8, each of the pixels is operated by a first scanning signal sn, a second scanning signal sn−1, a first light emitting control signal e1n, a second light emitting control signal e2n, and a third light emitting control signal e3n. The operation of the pixel is divided into a first interval Tel in which a first OLED emits light, a second interval Te2 in which a second OLED emits light, and a third interval Te3 in which a third OLED emits light.

As described above, a delta pixel circuit and a light emitting display in accordance with the present invention have the ability to precisely display a picture by three pixels arranged in a delta pattern, and, as three light emitting diodes are connected with one pixel circuit, the number of pixel circuits in the light emitting display (or light emitting displaying device) is reduced.

Accordingly, because the number of wires for supplying a signal can also be reduced due to the reduced number of the pixel circuits, a scan driver and a data driver can each be embodied within a smaller size area, and necessary space is reduced. Also, as the number of wires is reduced, a light emitting displaying device (or light emitting display) can have a simple wiring structure and a high aperture ratio.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A pixel comprising:

first, second, and third light emitting diodes arranged in a delta pattern and respectively corresponding to a red color, a green color, and a blue color;

a driving circuit commonly connected with the first, second, and third light emitting diodes and for supplying a current to each of the first, second, and third light emitting diodes; and a switching circuit connected between the driving circuit and the first, second, and third light emitting diodes and for selectively supplying the current to the first, second, and third light emitting diodes, wherein the driving circuit comprises:

a first transistor for receiving a first power of a first power source, and for selectively supplying the current to the first, second, and third light emitting diodes, the current corresponding to a first voltage supplied to a gate of the first transistor;

a second transistor for selectively supplying a data signal to a first electrode of the first transistor according to a first scanning signal;

a third transistor for selectively connecting the first transistor as a diode according to the first scanning signal;

a capacitor for storing a voltage supplied to the gate of the first transistor when a data voltage of the data signal is supplied to the first electrode of the first transistor and for maintaining the stored voltage at the gate of the first transistor during an emitting interval of at least one of the first, second, and third light emitting diodes;

a fourth transistor for selectively supplying an initializing signal to the capacitor according to a second scanning signal;

a fifth transistor for selectively supplying the first power of the first power source to the first transistor according to a first light emitting control signal;

a sixth transistor for selectively supplying the first power of the first power source to the first transistor according to a second light emitting control signal; and a seventh transistor for selectively supplying the first power of the first power source to the first transistor according to a third light emitting control signal.

2. The pixel as in claim 1, wherein the switch driving circuit comprises:

a first switching device connected between the driving circuit and the first light emitting diode and controlled according to the first light emitting control signal;

a second switching device connected between the driving circuit and the second light emitting diode and controlled according to the second emitting control signal; and a third switching device connected between the driving circuit and the third light emitting diode and controlled according to the third light emitting control signal.

3. The pixel as in claim 2, wherein the first light emitting control signal, the second light emitting control signal, and the third light emitting control signal respectively control the first switching device, the second switching device, and the third switching device to be turned on at different times.

4. The pixel as in claim 1, wherein the second scanning signal is applied to a second scanning line earlier than the first scanning signal is applied to a first scanning line.

5. The pixel as in claim 1, wherein the initializing signal comprises an initializing voltage supplied by the second scanning signal.

6. The pixel as in claim 1, wherein the initializing signal comprises an initializing voltage supplied to at least one of the first, second, and third light emitting diodes during a time interval when the first, second, and third light emitting diodes do not emit light.

7. The pixel as in claim 1, wherein each of the first, second, and third light emitting diodes is an organic light emitting diode.

8. A light emitting display comprising:

a plurality of pixels for displaying a picture;

a scan driver for supplying first and second scanning signals and a light emitting control signal to at least one of the plurality of pixels;

a data driver for supplying a data signal to the at least one of the plurality of pixels, wherein the at least one of the pixels comprises:

first, second, and third light emitting diodes arranged in a delta pattern and respectively corresponding to a red color, a green color, and a blue color;

a driving circuit commonly connected with the first, second, and third light emitting diodes and for supplying a current to each of the first, second, and third light emitting diodes; and a switching circuit connected between the driving circuit and the first, second, and third light emitting diodes and for selectively supplying the current to the first, second, and third light emitting diodes, wherein the driving circuit comprises:

a first transistor for receiving a first power of a first power source, and for selectively supplying the current to the first, second, and third light emitting diodes, the current corresponding to a first voltage supplied to a gate of the first transistor;

a second transistor for selectively supplying the data signal to a first electrode of the first transistor according to the first scanning signal;

a third transistor for selectively connecting the first transistor as a diode according to the first scanning signal;

a capacitor for storing a voltage supplied to the gate of the first transistor when a data voltage of the data signal is supplied to the first electrode of the first transistor and for maintaining the stored voltage at the gate of the first transistor during an emitting interval of at least one of the first, second, and third light emitting diodes;

a fourth transistor for selectively supplying an initializing signal to the capacitor according to the second scanning signal;

a fifth transistor for selectively supplying the first power of the first power source to the first transistor according to a first light emitting control signal;

a sixth transistor for selectively supplying the first power of the first power source to the first transistor according to a second light emitting control signal; and a seventh transistor for selectively supplying the first power of the first power source to the first transistor according to a third light emitting control signal.

9. The light emitting display as in claim 8, wherein the switch driving circuit comprises:

a first switching device connected between the driving circuit and the first light emitting diode and controlled according to the first light emitting control signal;

a second switching device connected between the driving circuit and the second light emitting diode and controlled according to the second emitting control signal; and a third switching device connected between the driving circuit and the third light emitting diode and controlled according to the third light emitting control signal.

10. The light emitting display as in claim 9, wherein the first light emitting control signal, the second light emitting control signal, and the third light emitting control signal respectively control the first switching device, the second switching device, and the third switching device to be turned on at different times.

11. The light emitting display as in claim 8, wherein the second scanning signal is applied to a second scanning line earlier than the first scanning signal is applied to a first scanning line.

12. The light emitting display as in claim 8, wherein the initializing signal comprises an initializing voltage supplied by the second scanning signal.

13. The light emitting display as in claim 8, wherein the initializing signal comprises an initializing voltage supplied to at least one of the first, second, and third light emitting diodes during a time interval when the first, second and third light emitting diodes do not emit light.

14. The light emitting display as in claim 8, wherein each of the first, second and third light emitting diodes is an organic light emitting diode.

15. The light emitting display as in claim 8, wherein the data driver sequentially supplies the data signal comprising a red color data, a green color data and a blue color data to a data line corresponding to the at least one of the pixels.

16. A driving circuit commonly connected with red, green, and blue light emitting diodes and for supplying a current to each of the red, green, and blue light emitting diodes, the driving circuit comprising:

a first transistor for receiving a first power of a first power source, and for selectively supplying the current to the red, green, and blue light emitting diodes, the current corresponding to a first voltage supplied to a gate of the first transistor;

a second transistor for selectively supplying a data signal to a first electrode of the first transistor according to a first scanning signal;

a third transistor for selectively connecting the first transistor as a diode according to the first scanning signal;

a capacitor for storing a voltage supplied to the gate of the first transistor when a data voltage of the data signal is supplied to the first electrode of the first transistor and for maintaining the stored voltage at the gate of the first transistor during an emitting interval of at least one of the red, green, and blue light emitting diodes;

a fourth transistor for selectively supplying an initializing signal to the capacitor according to a second scanning signal;

a fifth transistor for selectively supplying the first power of the first power source to the first transistor according to a first light emitting control signal;

a sixth transistor for selectively supplying the first power of the first power source to the first transistor according to a second light emitting control signal; and a seventh transistor for selectively supplying the first power of the first power source to the first transistor according to a third light emitting control signal.

17. The driving circuit as in claim 16, wherein the first transistor is coupled to the red light emitting diode via a first switching device controlled according to the first light emitting control signal, wherein the first transistor is coupled to the green light emitting diode via a second switching device controlled according to the second light emitting control signal, and wherein the first transistor is coupled to the blue light emitting diode via a third switching device controlled according to the third light emitting control signal.

18. The driving circuit as in claim 17, wherein the first light emitting control signal, the second light emitting control signal, and the third light emitting control signal respectively control the fifth transistor, the sixth transistor, and the seventh transistor to be turned on at different times.

19. The driving circuit as in claim 16, wherein the second scanning signal is applied to a second scanning line earlier than the first scanning signal is applied to a first scanning line.

20. The driving circuit as in claim 16, wherein the initializing signal comprises an initializing voltage supplied by the second scanning signal.

21. The driving circuit as in claim 16, wherein the initializing signal comprises an initializing voltage supplied to at least one of the red, green, and blue light emitting diodes during a time interval when the red, green, and blue light emitting diodes do not emit light.

* * * * *

UNITED STATES PATENT AND TRADEMARK OFFICE

CERTIFICATE OF CORRECTION

PATENT NO. : 7,880,698 B2
APPLICATION NO. : 11/274057
DATED : February 1, 2011
INVENTOR(S) : Sung Cheon Park et al.

It is certified that error appears in the above-identified patent and that said Letters Patent is hereby corrected as shown below:

On the Title Page

| | |
|---|---|
| (56) References Cited, OTHER PUBLICATIONS, page 2 | Insert -- U.S. Office action dated November 13, 2008, for related U.S. Application 11/129,016, indicating relevance of listed U.S. references in this IDS.-- |
| (56) References Cited, OTHER PUBLICATIONS, page 2 | Insert --U.S. Notice of Allowance dated November 4, 2008, for related U.S. Application 11/274,042, indicating relevance of listed U.S. references in this IDS.-- |
| (56) References Cited, OTHER PUBLICATIONS, page 2 | Insert --Patent Abstracts of Japan, Publication No. 2001-318628, dated November 16, 2001, in the name of Shunpei Yamazaki et al.-- |

Signed and Sealed this
Twenty-ninth Day of May, 2012

David J. Kappos

David J. Kappos
*Director of the United States Patent and Trademark Office*